United States Patent [19]

Boerzel et al.

[11] 4,229,174

[45] Oct. 21, 1980

[54] DISPERSANT FOR TEXTILE DYEING AND OPTICAL BRIGHTENING

[75] Inventors: Paul Boerzel, Frankenthal; Peter Freyberg, Speyer; Norbert Greif, Bobenheim; Rudi Widder, Leimen, all of Fed. Rep. of Germany

[73] Assignee: BASF Aktiengesellschaft, Fed. Rep. of Germany

[21] Appl. No.: 974,621

[22] Filed: Dec. 27, 1978

[30] Foreign Application Priority Data

Dec. 30, 1977 [DE] Fed. Rep. of Germany ..... 2758881

[51] Int. Cl.[2] ..... C09B 67/00

[52] U.S. Cl. ..... 8/588; 8/582

[58] Field of Search ..... 8/89, 173

[56] References Cited

U.S. PATENT DOCUMENTS

| | | | |
|---|---|---|---|
| 2,638,445 | 5/1953 | Young et al. | 252/33 |
| 3,170,004 | 2/1965 | Faragre | 8/173 X |
| 3,242,127 | 3/1966 | Clark et al. | 8/173 X |
| 4,101,274 | 7/1978 | Beutler et al. | 8/173 |

FOREIGN PATENT DOCUMENTS

| | | | |
|---|---|---|---|
| 49-27678 | 12/1974 | Japan | 8/173 |

*Primary Examiner*—Sandra M. Person

*Attorney, Agent, or Firm*—Keil & Witherspoon

[57] ABSTRACT

A process for dyeing textile materials, containing natural and/or synthetic fibers, in an aqueous liquor by means of dyes which are sparingly soluble or insoluble in water, in the presence of dyeing assistants, wherein the dispersant used is a water-soluble sulfonic acid which is derived from a random copolymer of olefins of 3 to 6 carbon atoms and styrene and/or substituted styrenes and/or their alkali metal salts or ammonium salts.

3 Claims, No Drawings

DISPERSANT FOR TEXTILE DYEING AND OPTICAL BRIGHTENING

The present invention relates to a process for dyeing or optically brightening textile materials comprising natural and/or synthetic fibers.

To prevent agglomeration of the dyes or optical brighteners when dyeing or optically brightening natural or synthetic fibers with dyes or optical brighteners which are sparingly soluble in water, a dispersant is provided in the dye or optical brightener liquor. Examples of conventional dispersants are the non-surface-active condensation products of β-naphthalenesulfonic acid or other aromatic sulfonic acids and formaldehyde and ligninsulfonates, and surface-active compounds such as adducts of ethylene oxide with phenols or naphthols, which may or may not be substituted, fatty alcohols, fatty amines and fatty acids. However, the conventional non-surface-active dispersants have the disadvantage that because of their affinity for various fibers they soil the fibers and reduce the lightfastness of the dyeing. A further disadvantage is that this group of dispersants exerts a reducing action in an acid liquor and therefore causes changes in hue or even a destruction of various disperse dyes of the azo series.

The conventional surface-active dispersants in most cases have only a moderate dispersing action, and retard various dyes. This latter property has a particularly adverse effect when dyeing polyester/wool fiber blends with 1:2 metals complex dyes and when dyeing polyester/cellulose fiber blends with vat dyes.

According to the invention, there is provided a process for dyeing or optically brightening a textile material comprising natural and/or synthetic fibers which process comprises contacting said textile material with an aqueous liquor which contains one or more optical brighteners or dyes which are sparingly soluble or insoluble in water and a dispersant which is a water-soluble sulfonic acid group-containing random copolymer of one or more olefins of 3 to 6 carbon atoms with styrene and/or a substituted styrene or which is an alkali metal salt or ammonium salt thereof.

The synthetic fibers referred to may be polyester, triacetate, acetate, nylon, polyacrylonitrile, anionically or cationically modified nylon or polyester fibers or a blend of two or more of these fibers, such fibers preferably being dyed using a disperse dye. Examples of the natural fibers are cellulose fibers and wool. Preferably, the process of the invention is applied to textile materials of polyester and cellulose fibers, of blends of polyester fibers and wool, and of blends of polyester fibers and cotton.

For the purposes of the invention, textile materials means fibers in any stage of processing, for example sliver, yarn, knitted fabric or woven fabric. The yarns may be in the form of hanks, packages or cheeses.

The process according to the invention can be carried out continuously or batchwise. In batchwise operation, exhaustion dyeing in an aqueous liquor is used, and the liquor ratio can be varied within a wide range, for example from 1:1 to 100:1, preferably from 10:1 to 50:1. Linear polyester fibers are preferably dyed by the high-temperature process in a closed vessel, under pressure, at above 100° C., preferably at from 110° to 140° C. Examples of closed vessels are circulation equipment such as cheese dyeing or beam dyeing machines, winch vats, jet dyeing and drum dyeing machines, paddle machines and jiggers. Linear polyester fibers can also be dyed at below 100° C., for example at from 75° to 98° C., in the presence of conventional carriers. Examples of carriers which may be employed are phenylphenols, polychlorobenzenes, xylenes, naphthalenes or diphenyl. Secondary acetate rayon fibers are preferably dyed at from 80° to 85° C., whilst cellulose triacetate fibers are dyed at the boiling point of the aqueous bath. When dyeing secondary acetate rayon fibers or nylon fibers, it is unnecessary to use a carrier.

When the process is carried out continuously, the textile material is in practice generally first padded with an aqueous liquor which contains a dye which is sparingly soluble or insoluble in water, eg. a disperse dye, and a sulfonated copolymer to be used according to the invention, with or without a thickener and one or more other assistants, and is then squeezed off to a wet pick-up of from 60 to 120%, based on the weight of the textile material, after which it is subjected to a heat treatment, eg. with steam at from 98° to 105° C., or with hot air at 130° C., to fix the dye, or is thermofixed at from 180° to 210° C.

For the purposes of the invention, dyes which are sparingly soluble or insoluble in water are, for example, disperse dyes, pigment dyes and vat dyes. Suitable dyes of these categories may be found in the Color Index.

The dyeing assistants to be used according to the invention may also be empolyed as dispersants when whitening undyed textile materials. In that case, an optical brightener which is sparingly soluble or soluble in water is employed instead of the dye.

When using an alkali metal salt the dispersant may in particular be a potassium salt or a sodium salt. Ammonium salts are preferred to alkali metal salts. The term ammonium salts is to be understood to include salts of derivatives of ammonia, for example, alkylamines (eg. methylamine, dimethylamine, diethylamine, trimethylamine and triethylamine), monoethanolamine, diethanolamine and triethanolamine.

The dispersant is particularly effective if it comprises, as copolymerized units, from 80 to 20% by weight of one or more olefins of 3 to 6 carbon atoms and from 20 to 80% by weight of styrene and/or a substituted styrene, and contains from 0.5 to 2 optionally salified sulfonic acid groups per styrene unit or substituted styrene unit in the copolymer. The copolymer preferably contains from 60 to 40% by weight of an olefin of 3 to 6 carbon atoms and from 40 to 60% by weight of styrene or of a styrene derivative. Examples of suitable styrene derivatives are α-methylstyrene, nuclear-substituted monohalogenated methylstyrenes, α-ethylstyrene, p-chlorostyrene and p-bromostyrene.

Amongst monoolefins of 3 to 6 carbon atoms, those of 4 carbon atoms are particularly important, and of these isobutene is especially so, either as the sole monoolefin or as a mixture of isobutene and one or more of its isomers, eg. 1-butene and 2-butene. Examples of other particularly suitable olefins are propylene, 1-pentene, 1-hexene and 4-methyl-1-pentene. The number-average molecular weight of the random copolymer in non-sulfonated form is generally from 400 to 3,000 and preferably from 700 to 1,500. The copolymers can be manufactured by conventional methods and sulfonated with conventional agents, of. U.S. Pat. No. 2,638,445. The number of sulfonic acid groups per unit of styrene or styrene derivative in the copolymer is usually from 0.5 to 2, preferably from 0.7 to 1.

The copolymers can be prepared continuously or batchwise, in a stirred kettle or in a flow-tube reactor, under atmospheric or superatmospheric pressure. Random copolymers having a relatively low molecular weight of about 500 and a styrene content of less than 50% by weight can be prepared in the absence of a solvent. In general, however, the polymerization is carried out in a solvent, eg. gasoline or hexane or a chlorohydrocarbon. The molecular weight of the random copolymers can be varied by varying the polymerization temperature. In general, the polymerization is carried out at from −20° to +40° C. in the presence of a Friedel-Krafts catalyst, eg. boron trifluoride or one of its adducts, an alkyl-aluminum halide, titanium tetrachloride or tin tetrachloride. The polymerization can be stopped by adding methanol. The copolymer can be isolated in a pure form by distilling off the solvent, but such isolation is not necessary because the copolymer can be sulfonated directly, in the inert solvent, for example by means of oleum, chlorosulfonic acid or sulfur trioxide.

The sulfonated random copolymers described above are excellent dispersants which are stable to hard water, traces of heavy metals, weak acids and alkaline pH. They are compatible with other anionic or with nonionic dyeing assistants and are not steam-volatile. Furthermore, they do not detract from the fastness of the dyeings. The above sulfonated random copolymers and their salts are generally employed in the process according to the invention in an amount of from 0.1 to 10, preferably from 0.2 to 5, g/l of liquor.

The dye or optical brightener liquor may contain one or more mineral acids, eg. sulfuric acid or phosphoric acid, or one or more organic acids, such as aliphatic carboxylic acids, eg. formic acid, acetic acid, propionic acid or oxalic acid, and/or salts of such inorganic and organic acids, eg. ammonium acetate, ammonium sulfate or sodium acetate, in order to adjust its pH. The pH of the liquor is in general from 4 to 8, preferably from 4.5 to 6.5. The liquor may also contain, for example, a levelling agent, anti-foam agent or thickener.

According to a preferred dyeing method, a liquor which contains the dispersant to be used according to the invention, with or without other assistants, and which is at a temperature of, for example, from 40° to 70° C., is prepared. The goods to be dyed are treated with this liquor for from about 5 to 15 minutes. The dye, with or without a carrier, is then added to the liquor and the temperature of the liquor is raised to a value at which dyeing is finished within from 30 to 100 minutes. The dyed material is then rinsed and dried in the conventional manner. A reductive after-treatment is normally not necessary. The goods to be dyed are in general static in the dyeing apparatus whilst the liquor circulates through the goods. It is important to ensure not only that the dye is finely dispersed at the start of the dyeing operation but also that this degree of dispersion of the dye is maintained throughout the dyeing process. Using the process according to the invention, even and deep dyeings, distinguished by good fastness to crocking and good tinctorial yield, are obtained on synthetic textile materials, especially on linear polyester fibers, on cellulose fibers, and on blends of polyester fibers and cellulose fibers.

The compounds to be used according to the invention prove particularly advantageous in connection with the high-temperature dyeing of polyester fibers with disperse dyes. In this method, dyeing is normally carried out in a closed vessel under pressure at above 110° C., eg. at from 110° to 140° C. In order to be able to keep the pressure vessels as small as possible, a relatively short liquor is generally used. Whilst commercial disperse dyes tend to change into a less fine form under high-temperature dyeing conditions, so that a substantial proportion of the dye is no longer absorbed by the fibers and instead settles out on the surface of the goods being dyed, such coarsening of the dye, and the resulting deposition of pigment under the dyeing conditions, can be avoided by adding the sulfonated random copolymers of olefins and aromatic compounds used according to the invention. Satisfactory deep dyeings are obtained by the process of the invention.

The Examples which follow illustrate the invention. In the Examples, parts and percentages are by weight. The molecular weights of the copolymers are number-average molecular weights and were determined by vapor pressure osmometry in toluene as the solvent, in a Mechrolab osmometer (Hewitt-Packard); the values quoted were extrapolated to zero concentration. The Table which follows characterizes the various dispersants used in the individual Examples.

TABLE

| Dispersant | Isobutene content (% by weight) | Styrene content (% by weight) | Molecular weight of the copolymer $\overline{M}_n$ | Degree of sulfonation = styrene: $SO_3H$ ratio | Cation |
|---|---|---|---|---|---|
| A | 30 | 70 | 2,000 | 1:1 | $Na^+$ |
| B | 35 | 65 | 1,500 | 1:1 | $Na^+$ |
| C | 35 | 65 | 1,500 | 1:0.7 | $Na^+$ |
| D | 50 | 50 | 900 | 1:0.9 | $NH_4^+$ |
| E | 47 | 53 | 600 | 1:0.9 | $NH_4^+$ |
| F | 54 | 46 | 1,700 | 1:1 | $NH_4^+$ |
| G | 56 | 44 | 700 | 1:1 | $K^+$ |
| H | 70 | 30 | 800 | 1:1 | $Na^+$ |
| I | 70 | 30 | 800 | 1:0.9 | $NH_4^+$ |
| J | 22 | 78 | 1,300 | 1:0.7 | $NH_4^+$ |
| K | 64 | 36 | 1,100 | 1:0.8 | $Na^+$ |

EXAMPLE 1

50 parts of polyester staple fiber yarn in cheese form are dyed in 1,000 parts of an aqueous liquor which contains 2 parts of the yellow disperse dye Color Index No. 47,023, 1 part of dispersant A and 0.5 part of 30% strength acetic acid. The pH of the liquor is 5. Dyeing takes place in a closed dyeing apparatus, the liquor being circulated by pumping it through the cheese, the direction of flow being changed constantly. The liquor is heated from 60° to 130° C. in the course of 30 minutes. The yarn is dyed for 60 minutes at 130° C. and the liquor is then cooled to 90° C. and drained off. The textile material is then treated with a fresh liquor which contains 0.5 g/l of sodium hydroxide, 2 g/l of sodium dithionite and 0.5 g/l of a nonionic detergent (an adduct of 1 mole of oleylamine with 12 moles of ethylene oxide), subjected to reductive afterscouring for about 20 minutes at 70° C. and then rinsed once with warm water and once with cold water. A level, washfast and crockfast yellow dyeing is obtained.

EXAMPLE 2

Example 1 is repeated, but using 1.5 parts of the disperse dye Color Index No. 62,030 as the dye and 0.5 part of dispersant D as the dyeing assistant. A level, washfast and crockfast violet dyeing is obtained.

EXAMPLE 3

The procedure described in Example 1 is followed, but 1.5 parts of the disperse dye Color Index No. 60,756 are used as the dye and 4 parts of dispersant B as the dyeing assistant. A level, washfast and crockfast red dyeing is obtained.

EXAMPLE 4

The procedure described in Example 1 is followed, but 1.5 parts of the disperse dye Color Index No. 26,080 are used as the dye and 2 parts of dispersant C as the dyeing assistant. A level, washfast and crockfast orange dyeing is obtained.

EXAMPLE 5

Example 4 is repeated several times, in each case using one of the dispersants listed under E to K in the Table, instead of dispersant C. In every case, a level and crockfast orange dyeing is obtained.

EXAMPLE 6

50 parts of a polyester staple fiber fabric wound on a dyeing beam are dyed in 1,000 parts of an aqueous liquor which contains 1.5 parts of the red disperse dye of German Patent 1,271,284, Example 4, column 9, line 1, 0.5 part of 30% strength acetic acid and, as the dyeing assistant, 1 part of one of the dispersants mentioned below. Dyeing is carried out in a closed dyeing apparatus, with the liquor circulating outward only. Dyeing is started at 50° C., the temperature is then raised to 130° C. in the course of 30 minutes and dyeing is continued for 60 minutes at this temperature. The liquor is then cooled to 70° C. and drained off. Thereafter, the fabric is unwound from the dyeing beam and the deposit of dye on the polyester fabric is assessed, first visually and then colorimetrically. For the colorimetric determination of the dye deposits, pieces of fabric of a particular size are cut from various parts of the unwound strip of fabric and are extracted with acetone. The pigment deposit is most pronounced on the inside, directly against the perforated dyeing beam carrier, and decreases with increasing distance from the inside layer. The slighter the pigment deposit and the greater the decrease in pigment deposit with distance from the dyeing beam carrier, the better is the action of the dyeing assistant. The dispersants B, C, D, E, F, H and I listed in the Table were tested in comparison with commercial dispersants, such as β-naphthalenesulfonic acid/formaldehyde condensates. The novel dispersants mentioned above gave substantially smaller pigment deposits on the pieces of fabric than did the commercial dispersants.

EXAMPLE 7

The procedure described in Example 6 is followed, but 1.5 parts of the disperse dye Color Index No. 62,015 are used as the dye. Here again, substantially slighter pigment deposits on the goods are found when using 0.5 part of one of the dispersants mentioned in Example 6 than is possible with commercial dispersants based on β-naphthalenesulfonic acid and formaldehyde.

EXAMPLE 8

The procedure described in Example 6 is followed, but 1.5 part of the blue disperse dye of Example 10 of German Patent No. 1,176,777 are used as the dye, and dyeing is carried out for only 30 minutes at 130° C. instead of 60 minutes. Here again, substantially slighter pigment deposits are found when using the dispersants B, C, D, E, F, H and I in an amount of 1 g/l than when using the same amount of a β-naphthalenesulfonic acid/formaldehyde condensate.

EXAMPLE 9

This Example illustrates the dispersant action of the agents to be used as dyeing assistants according to the invention. 4 portions, each of 0.2 g, of the disperse dye Color Index No. 11,100, the dye being in the form of a non-finished 50% strength aqueous press cake, are worked into a paste with 3 ml of water and with increasing amounts, namely 0.5 g, 1 g, 1.5 g and 2 g, of dispersant G. 16 ml of boiling water are poured over each of the paste samples, and the mixture is boiled for 3 minutes and then poured into 500 ml of water at 70°. The resulting diluted dispersion is filtered on a suction filter preheated to 70° C., using a 9 cm filter paper (Schleicher & Schüll No. 1450 CV). It is found that with increasing amounts of dispersant the filter residue becomes progressively less.

If instead of dispersant G the same amount of a commercial dispersant consisting of a β-naphthalenesulfonic acid/formaldehyde condensate or of ligninsulfonates is used, the filter residue is greater, under otherwise identical conditions, because of the lesser dispersant action of these commercial assistants.

Similar results are obtained if instead of dispersant G, dispersants A, C, D, E, F and K, to be used according to the invention, are employed.

EXAMPLE 10

100 parts of a fabric wound on a dyeing beam and consisting of a mixture of 67% of polyester fibers and 33% of cotton fibers are dyed in 1,000 parts of an aqueous liquor which contains 3.6 parts of the disperse dye of German Patent No. 1,176,777, Example 10, 0.35 part of the disperse dye Color Index No. 47,023 and 1.76 parts of the vat dye Color Index No. 59,825 as a commercial dye in liquid form, 3 parts of dispersant E and 0.5 part of 30% strength acetic acid. Dyeing is carried out in a closed dyeing apparatus, with outward circulation of liquor. Dyeing is started at 50° C., the temperature is raised to 130° C. in the course of 45 minutes, dyeing is continued for 90 minutes at the same temperature, the liquor is then cooled to 70° C., and 20 parts of sodium hydroxide solution of 38° Bé strength and 5 parts of sodium dithionite are added to reduce the vat dye. After 10 minutes, the liquor is cooled to 50° C. and after a further 10 minutes the fabric is rinsed with cold water by overflow. The dyeing is then finished in the conventional manner for vat dyes, namely by oxidizing, soaping and rinsing. A level, fast green dyeing is obtained.

EXAMPLE 11

50 parts by weight of a yarn of a blend of 55% of polyester fibers and 45% of wool, in cheese form, are dyed in 1,000 parts of a liquor which contains 0.5 part of the disperse dye Color Index No. 26,080 and 0.05 part of the acid dye Color Index No. 18,762, 1.0 part of dispersant B, 1 part of a mixture of 75% of trichlorobenzene and 25% of a commercial anionic emulsifier and 0.5 part of 30% strength acetic acid. Dyeing is carried out in a closed dyeing apparatus with alternating direction of liquor circulation. The liquor, initially at 50° C., is heated to 104° C. in the course of 45 minutes, dyeing is continued for 60 minutes at this temperature, the liquor is then cooled slowly by adding cold water by the overflow method, and the textile material is rinsed for about 10 minutes. It is then after-scoured for about 20 minutes at 50° C. in a liquor which contains 0.5 ml/l of acetic acid and 1 g/l of a nonionic detergent (an adduct of 1 mole of castor oil with 40 moles of ethylene oxide). A fast level dyeing is obtained.

EXAMPLE 12

100 parts by weight of a grey cotton yarn in cheese form are dyed in 1,000 parts of an aqueous liquor which initially contains only water and 2 parts of dispersant D. The fully wound cheese is heated to 105° C. in the dyeing apparatus and is left at this temperature for 10 minutes. The liquor is then cooled to 85° C. At this temperature, 3 parts of the vat dye Color Index No. 69,825, in the form of a commercial dye, are added, the liquor temperature is lowered to 65° C., 22 ml of sodium hydroxide solution of 38° Bé strength are then added and after 5 minutes 6 g of sodium dithionite are introduced. The material is then dyed for 45 minutes at 65° C. and then rinsed by overflow in the conventional manner, after which the dyeing is finished by oxidizing, soaping and rinsing. A level, blue dyeing is obtained. Crocking fastness measurements show that the dyeing is very fast compared to dyeings obtained in the presence of conventional dispersants.

EXAMPLE 13

33.3 parts by weight of a knitted fabric of texturized polyester yarn are dyed in 1,000 parts of an aqueous liquor of pH 5, which contains 1.33 parts by weight of the disperse dye Color Index No. 47,023 or 1 part by weight of the disperse dye Color Index No. 62,030, 1.33 parts by weight of dispersant D and about 0.5 part by weight of 30% strength acetic acid. Dyeing takes place in a closed apparatus, eg. a high-temperature winch or a jet dyeing machine. The liquor is heated from 60° to 130° C. in the course of 30 minutes, the fabric is dyed for a further 90 minutes at the same temperature, and the liquor is cooled to 90° C. and drained off. The textile material is then rinsed for about 20 minutes at 70° C. in a fresh liquor which contains 1.0 g/l of calcined sodium carbonate and 0.5 g/l of a nonionic detergent (eg. an adduct of oleylamine with 12 moles of ethylene oxide); thereafter the fabric is rinsed further with warm and cold water and is acidified.

Level, washfast and crockfast dyeings are obtained.

We claim:

1. A process for dyeing textile materials, containing natural and/or synthetic fibers, in an aqueous liquor, with dyes which are sparingly soluble or insoluble in water and are selected from the group comprising the disperse dyes, pigment dyes, vat dyes and optical brighteners, wherein the dispersant used is a water-soluble sulfonic acid group containing random copolymer of from 80 to 20% by weight of olefins of 3 to 6 carbon atoms and from 20 to 80% by weight of a monomer selected from the group comprising styrene, α-methylstyrene, nuclear-substituted monohalogenated methylstyrenes, α-ethylstyrene, p-chlorostyrene and p-bromostyrene, which random copolymers contain from 0.5 to 2 sulfonic acid groups per styrene or substituted styrene unit in the copolymer.

2. A process as set forth in claim 1, wherein a sulfonated copolymer of isobutene and styrene is employed.

3. A process as set forth in claim 1, wherein the water-soluble copolymer is employed in the aqueous liquor in an amount of from 0.1 to 10 g/l.

* * * * *